US008002014B2

(12) United States Patent
Roth et al.

(10) Patent No.: US 8,002,014 B2
(45) Date of Patent: Aug. 23, 2011

(54) PROCESS FOR PRODUCING METAL-CONTAINING CASTINGS, AND ASSOCIATED APPARATUS

(75) Inventors: Stefan Roth, Dresden (DE); Ludwig Schultz, Dresden (DE)

(73) Assignee: Leibniz-Institut fuer Festkoerper-und Werkstofforschung Dresden E.V., Dresden (DE)

( * ) Notice: Subject to any disclaimer, the term of this patent is extended or adjusted under 35 U.S.C. 154(b) by 387 days.

(21) Appl. No.: 11/997,634

(22) PCT Filed: Jul. 28, 2006

(86) PCT No.: PCT/EP2006/064809

§ 371 (c)(1),
(2), (4) Date: Jul. 29, 2008

(87) PCT Pub. No.: WO2007/014916

PCT Pub. Date: Feb. 8, 2007

(65) Prior Publication Data

US 2008/0295991 A1 Dec. 4, 2008

(30) Foreign Application Priority Data

Aug. 2, 2005 (DE) ..... 10 2005 037 982

(51) Int. Cl.
*B22D 17/00* (2006.01)
*B22D 27/02* (2006.01)
*B22D 27/13* (2006.01)

(52) U.S. Cl. ..... 164/48; 164/66.1; 164/113; 164/492

(58) Field of Classification Search ..... 164/48, 164/492, 250.1

See application file for complete search history.

(56) References Cited

U.S. PATENT DOCUMENTS

| | | | | |
|---|---|---|---|---|
| 3,498,894 A | | 3/1970 | Jerome et al. | |
| 3,752,216 A | * | 8/1973 | Fritsche | 164/509 |
| 5,740,854 A | * | 4/1998 | Inoue et al. | 164/495 |
| 6,820,679 B1 | | 11/2004 | Lutze | |
| 2007/0107467 A1 | | 5/2007 | Miwa et al. | |
| 2011/0000585 A1 | * | 1/2011 | Poon et al. | 148/403 |

FOREIGN PATENT DOCUMENTS

| | | | |
|---|---|---|---|
| CH | 500 763 | | 2/1971 |
| DE | 2 218 454 | | 10/1973 |
| DE | 42 07 694 | | 9/1993 |
| DE | 199 50 037 | | 5/2001 |
| DE | 10 2004 018 664 | | 11/2005 |
| EP | 0 800 879 | | 10/1997 |
| GB | 2265805 | | 10/1993 |
| JP | 2005-120473 | | 5/2005 |
| WO | WO-01/28713 | * | 4/2001 |
| WO | 2005/099934 | | 10/2005 |

OTHER PUBLICATIONS

Jardy A: "Modelisation Mathematique Du Procede De Refusion A L'Arc Sous Vide Mathematical Modelling of the Vacuum ARC Remelting Process" Revue De Maetallurgie, Paris, FR, vol. 100, No. 6, Jun. 2003, pp. 595-605, XP001177251 ISSN: 035-1563.

M. Ishida et al: "Fillability and imprintability of high-strength Ni-based bulk metallic glass prepared by the precision die-casting technique" Materials Transactions. Jim, Sendai, JP, vol. 45, No. 4, Apr. 2004, pp. 1239-1244, XP001247667 ISSN: 0916-1821.

S. Bossuyt et al. Materials Science and Engineering A 375-377 (2004) pp. 240-243.

English language Abstract of EP 0 800 879, Oct. 15, 1997.

English language Abstract of JP 2005-120473, May 12, 2005.

* cited by examiner

*Primary Examiner* — Kuang Lin

(74) *Attorney, Agent, or Firm* — Greenblum & Bernstein, P.L.C.

(57) ABSTRACT

Method such as can be used, for example, for producing molded articles from metallic glasses. Method and apparatus are provided in which a good mold filling during casting is achieved in addition to high cooling rates. The method includes introducing a metal-containing melt into an electrically conducting casting mold, the metal-containing melt and the mold being connected in an electrically conducting manner to the outputs of the same voltage source during the introduction into a casting mold, so that a preset current flows through the boundary interface between the melt and the mold. Apparatus is also provided in which there is an electrically conducting connection to a voltage source between a metal-containing melt and an electrically conducting mold for the melt.

4 Claims, No Drawings

PROCESS FOR PRODUCING METAL-CONTAINING CASTINGS, AND ASSOCIATED APPARATUS

FIELD OF THE INVENTION

The invention relates to the fields of materials sciences and process engineering and relates to a method for producing metal-containing castings, such as can be used, for example, for producing molded articles from metallic glasses, and an apparatus for implementing this method.

BACKGROUND INFORMATION

A metallic glass is a metastable alloy that does not have any long-range order, in contrast to normal crystalline materials. Its structure is amorphous and is similar to that of a liquid. Several conditions must be met in order to obtain the amorphous state during cooling. For instance, the nucleation and nucleus growth must be suppressed in order to freeze the structure of the liquid. In order to realize this, the metallic melt must be cooled very quickly, for example, through contact with the surface of a heat sink that conducts heat very well. The quality of the thermal contact and the thickness and heat conductivity of the liquid layer determine the cooling rate.

A known and very widespread method of casting metals as well as solid metallic glasses is casting into cold ingot molds. The melt is thereby forced into the ingot mold by various methods and sets there in the shape predetermined by the ingot mold.

In order to obtain high cooling rates in the case of metallic glasses, the ingot mold is produced from a material that conducts heat well. The casting operation thereby takes place very quickly. Firstly, the metal is melted in a crucible, and subsequently the melt is forced into the mold by gas pressure or centrifugal force.

The surface of the mold must be very clean in order to ensure a good thermal contact between the metallic melt and the ingot mold, advantageously made of copper. This can be easily realized by mechanical cleaning and pickling. Moreover, the melt should wet the mold well. The wetting depends essentially on the viscosity and interfacial surface tension of the melt with respect to the copper ingot mold and with respect to the ambient atmosphere. The viscosity depends very much on the temperature. It decreases exponentially with rising temperature, while the interfacial surface tensions decrease linearly with rising temperature. Low values for viscosity and interfacial surface tension, such as are desirable for a good wetting and for a good filling of the mold, can be set in principle by a high temperature. However, an increase in temperature also results in a higher quantity of heat to be removed, which leads to a lower cooling speed and therefore is not desirable. Overheating the melt when casting crystalline alloys leads to a good filling of the mold, but overheating should be avoided when casting metallic glasses in order to be able to freeze the amorphous state.

It is furthermore known that contaminations of the melt with oxygen interfere with the producibility of metallic glasses and impair their properties. This effect is explained by heterogeneous nucleation on oxide particles in the melt. A method for electrochemical cleaning of the melt before casting through a current flow between a slag floating on the melt and the metal melt was described by S. Bossuyt et al., Mater. Sci. Eng. A 375-377 (2004) 240-243.

SUMMARY OF THE INVENTION

The present invention provides a method for producing metal-containing castings and associated apparatus, with which a good mold filling during casting without overheating a metal-containing melt is achieved in addition to high cooling rates.

With the method according to the invention for producing metal-containing castings, a metal-containing melt is introduced into an electrically conducting casting mold, the metal-containing melt and the mold being connected in an electrically conducting manner to the outputs of the same voltage source during the introduction into a casting mold, so that a preset current flows through the boundary interface between the melt and the mold.

Advantageously, the metal-containing melt is composed more than 50% by weight of a metal.

Likewise advantageously, molten amorphous metals are used as a metal-containing melt.

Furthermore advantageously, a casting mold made of a metal that conducts heat well, even more advantageously of copper, is used.

It is also advantageous if the metal-containing melt is connected to a voltage source via an electrode.

It is also advantageous if an induction-heated metal-containing melt is used.

It is likewise advantageous if a voltage of 0.5 V to 42 V is collected at the voltage source.

It is furthermore advantageous if the introduction of the metal-containing melt into the casting mold is implemented by means of the die casting process.

With the apparatus according to the invention for producing metal-containing castings, there is an electrically conducting connection between a metal-containing melt and a voltage source. Furthermore, an electrically conducting casting mold is present, into which the metal-containing melt should be introduced, which casting mold is likewise connected in an electrically conducting manner to the same voltage source as the metal-containing melt.

Advantageously, the metal-containing melt is located in an apparatus for melting metals, still more advantageously, in an induction furnace.

It is furthermore advantageous if the metal-containing melt is connected to a voltage source via an electrode, advantageously via a tungsten electrode.

It is also advantageous if a casting mold made of a material that conducts heat well, preferably copper, is used.

Through the method according to the invention and the apparatus according to the invention a good mold filling is achieved with high cooling rates without overheating the metal-containing melt.

DETAILED DESCRIPTION

The application of electric voltage between the metal-containing melt and the electrically conducting casting mold at least during the introduction into the casting mold reduces the interfacial surface tension of the metal-containing melt. This leads to a good thermal contact between the metal-containing melt and the electrically conducting casting mold, through which an even better filling of the casting form is achieved without overheating the metal-containing melt. More complex molded parts, e.g., of solid metallic glasses, can also be produced more easily and with larger dimensions with the method and apparatus according to the invention.

Advantageously, the introduction of the metal-containing melt into the casting mold takes place by means of die casting technology. The melting and casting of the metal-containing compounds thereby takes place in a closed system in an inert gas atmosphere.

The likewise advantageously inductively melted metal-containing melt is pressed into the mold, e.g., by overpressure of the atmosphere, e.g., argon atmosphere.

The voltage can be changed depending on the shaping process or also during a shaping process. A short-circuit current between the metal-containing melt and the electrically conducting casting mold is thereby preset.

The main advantage of the solution according to the invention is the targeted adjustability of the wetting behavior between melt and mold without overheating the melt, so that the melt wets the mold better and the contact between melt and mold becomes more homogeneous. Depending on the type of melt, specific property improvements result for different materials.

Another advantage of the solution according to the invention is that through the application of the electric voltage during the shaping process, with soft-magnetic materials the coercitive field strength of the castings produced is lower and their magnetization is higher. This is achieved through lower internal voltages during the shaping, which is attributable to the more homogeneous cooling and then leads to improved magnetic and mechanical properties of the product produced according to the invention. Moreover, complex shapes are shaped better and the products produced according to the invention are also more mechanically stable.

EXAMPLES

The invention is explained in more detail below based on several exemplary embodiments.

Example 1

A metal melt is produced from 100 g of a FeCPBSiMn alloy (cast iron with the addition of boron and phosphorus) in an induction furnace in argon atmosphere. A tungsten electrode extends into the metallic melt, which electrode is connected to a voltage source. A copper ingot mold is arranged under the induction furnace, which ingot mold contains recesses for shaping a cast washer. A washer is to be cast with the dimensions, internal diameter=18 mm, external diameter=26 mm, thickness=1 mm. The copper ingot mold is likewise connected to the voltage source in an electrically conductive manner. After application of the voltage of 230 V, the outlet in the induction furnace is opened. At the same time an argon overpressure of 200 kPa is applied. The metallic melt is thus pushed into the recess in the copper ingot mold and fills it completely due to the lower surface tension. After the cooling and opening of the copper ingot mold, a complete washer with the desired dimensions is obtained.

Example 2

The alloy $Fe_{65.5}Cr_4Mo_4Ga_4P_{12}C_5B_{5.5}$ cannot be cast amorphously to form a washer according to the methods of the prior art. According to the method according to claim 1, a complete washer can now be produced from this alloy, the product being available in an amorphous form.

The invention claimed is:

1. Method for producing metal-containing castings, comprising introducing a metal-containing melt comprising amorphous metal from an induction furnace into an electrically conducting copper casting mold while flowing a preset current through a boundary interface between the metal-containing melt and the casting mold, with the metal-containing melt and the casting mold being connected in an electrically conducting manner to outputs of a same voltage source during the introduction into the casting mold, a voltage of 0.5 V to 42 V is collected at a voltage source, and the introducing a metal-containing melt comprises melting the metal-containing melt in the induction furnace and introducing the melt in a closed system with superatmospheric pressure of an inert gas atmosphere into the casting mold arranged thereunder, and after application of a voltage between an electrode protruding into the melt and the casting mold, an outflow opening in the induction furnace is opened and the melt is transferred into the casting mold by applying the superatmospheric pressure, so that a preset current flows through the boundary layer between the melt and the casting mold.

2. Method according to claim 1, wherein the metal-containing melt comprises more than 50% by weight of a metal.

3. Method according to claim 1, wherein the metal-containing melt is connected to the voltage source via an electrode.

4. Method according to claim 1, wherein the introducing a metal-containing melt into the casting mold includes introducing via a die casting process.

* * * * *